US007384035B2

(12) United States Patent
Detloff

(10) Patent No.: US 7,384,035 B2
(45) Date of Patent: Jun. 10, 2008

(54) CONFIGURATION FOR GENERATING THROTTLED BLOWING AIR OR SUCTION AIR

(75) Inventor: Andreas Detloff, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 394 days.

(21) Appl. No.: 11/041,552

(22) Filed: Jan. 24, 2005

(65) Prior Publication Data

US 2005/0167905 A1 Aug. 4, 2005

(30) Foreign Application Priority Data

Jan. 29, 2004 (DE) ..... 10 2004 004 396

(51) Int. Cl.
*B65H 29/24* (2006.01)

(52) U.S. Cl. ..... 271/194; 271/195

(58) Field of Classification Search ..... 271/194, 271/276, 196, 197
See application file for complete search history.

(56) References Cited

U.S. PATENT DOCUMENTS 3,514,074 A 5/1970 Self
4,555,013 A * 11/1985 Franklin ..... 198/689.1
4,591,140 A * 5/1986 Illig et al. ..... 271/11
5,915,304 A * 6/1999 Stiel ..... 101/416.1
6,523,572 B1 * 2/2003 Levin et al. ..... 138/37
6,543,948 B2 * 4/2003 Beehler et al. ..... 400/635
6,612,235 B2 * 9/2003 Frankenberger et al. .... 101/231
6,648,326 B2 * 11/2003 Hieb ..... 271/183
6,659,446 B2 * 12/2003 Fischer et al. ..... 271/97
6,725,775 B2 4/2004 Palmatier et al.
7,219,889 B2 * 5/2007 Hachmann et al. ..... 271/264
2002/0096068 A1 7/2002 Frankenberger et al.

FOREIGN PATENT DOCUMENTS

DE 199 26 749 A1 12/2000
DE 102 02 254 A1 8/2002
JP 06009112 A * 1/1994
WO 01/14752 A1 3/2001

* cited by examiner

*Primary Examiner*—Joe H. Cheng
*Assistant Examiner*—Patrick D Cicchino
(74) *Attorney, Agent, or Firm*—Laurence A. Greenberg; Werner H. Stemer; Ralph E. Locher

(57) ABSTRACT

A configuration for generating blowing air or suction air, in particular a directing element in a sheet-processing machine, has a throttle path formed with vortex chambers. The vortex chambers generate vortex flows in a flow channel and they are formed by projections on just one side of the flow channel. This allows the element to be advantageously produced by molding, such as injection molding, thermo-molding, or stamping.

10 Claims, 5 Drawing Sheets

CONFIGURATION FOR GENERATING THROTTLED BLOWING AIR OR SUCTION AIR

This application claims the priority of German patent application No. 10 2004 004 396.5, filed Jan. 29, 2004; the entire disclosure of the prior application is herewith incorporated by reference.

BACKGROUND OF THE INVENTION

Field of the Invention

The invention relates to an configuration for generating throttled blowing air or suction air. A pneumatic pressure generator is connected to the start of a throttle path, blowing air or suction air flowing into the throttle path and blowing air or suction air which is throttled by vortexing in the throttle path flowing in or out at the end of the throttle path.

Such throttle paths are known, for example, from international PCT publication WO 01/14752 A1 (see U.S. Pat. No. 6,523,572 B1). In order to form a throttle path, a number of crosspieces and a plurality of chambers, each formed from two adjacent crosspieces, are provided. The chambers are arranged alternately opposite one another such that one crosspiece is located opposite in each case one chamber. The level of structural outlay is high and cost-intensive.

SUMMARY OF THE INVENTION

It is accordingly an object of the invention to provide a configuration for producing throttled blowing air or suction air which overcomes the above-mentioned disadvantages of the heretofore-known devices and methods of this general type and which provides for a simple and straightforward alternative.

With the foregoing and other objects in view there is provided, in accordance with the invention, a configuration for generating throttled blowing or suction air, comprising:

a body formed with an inlet, an outlet, and a throttle path between the inlet and the outlet;

the throttle path having a first wall formed with a plurality of mutually spaced-apart projections with tips and a second wall;

mutually adjacent the projections on the first wall of the throttle path forming vortex chambers therebetween, and a flow channel being defined between the tips of the projections and the second wall.

In accordance with an added feature of the invention, the throttle path is constructed from a plurality of layers formed with through-passages.

In accordance with an additional feature of the invention, the throttle path is constructed substantially from two parts, including a bottom part defining the throttle path and being produced by injection molding, thermo-forming, or stamping. Preferably, the bottom part is formed of plastic material.

In accordance with a further feature of the invention, there is provided an antechamber that communicates with a plurality of throttle paths and connects to a blowing-air or suction-air generator.

It is a particular advantage of the invention that the novel throttle path has a straightforward construction and is cost-effective to produce. Furthermore, it has extremely good sealing in relation to the surroundings. It has been found to be completely sufficient if just one side of the throttle path has projections and vortex chambers formed between the same, whereas the throttle wall located opposite the projections can remain untreated.

In the case of a second exemplary embodiment, provision is advantageously made for the distance (gap) between the projections and the opposite throttle wall to be produced by a plate or panel with through-passages being arranged between two throttle-path-forming layers such that the through-passage is arranged in the region of the respective throttle path.

In a preferred implementation of the invention, the configuration is advantageously formed in a sheet-directing element in a sheet-processing machine. For example, the sheet-directing element may be used in the region of a chain guide for moving sheets to the delivery of the sheet-processing machine.

In accordance with a concomitant feature of the invention, the throttle path is used in sheet-directing elements of a sheet-fed rotary printing machine.

Other features which are considered as characteristic for the invention are set forth in the appended claims.

Although the invention is illustrated and described herein as embodied in a configuration for generating throttled blowing air or suction air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
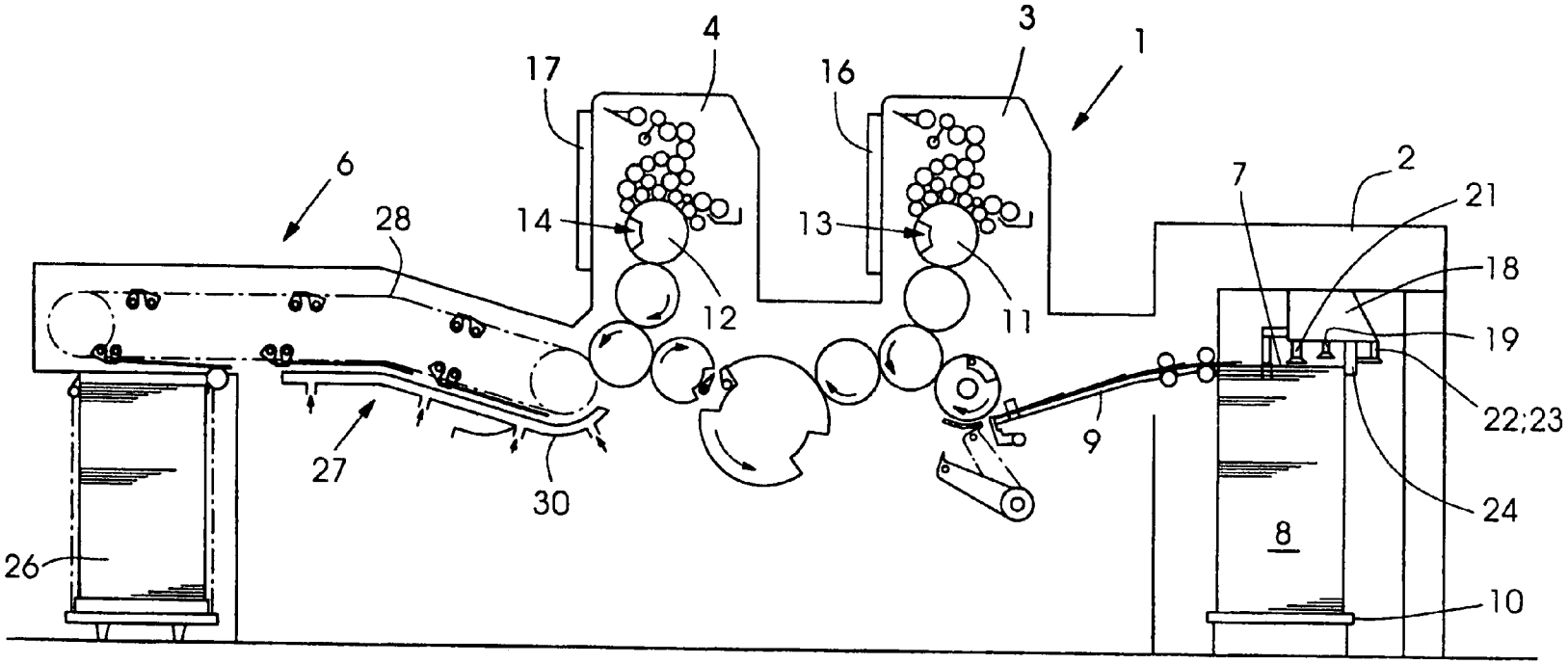
FIG. 1 is a schematic side view of a sheet-fed rotary printing machine.

Referring now to the figures of the drawing in detail and first, particularly, to FIG. 1 thereof, there is shown a machine 1 which processes sheets 7, such as, for instance, a printing press. The machine 1 has a feeder 2, at least one printing unit 3, 4 and a delivery 6. The sheets 7 are removed from a sheet stack 8 and fed separately or in imbricated form to the printing units 3 and 4 via a feed table 9. These printing units each contain, in a conventional setup, a plate cylinder 11, 12. Each of the plate cylinders 11 and 12 has an assembly 13, 14 for fastening flexible printing plates. Furthermore, each plate cylinder 11; 12 is assigned an assembly 16; 17 for semi-automatic or fully automatic printing-plate changeover.

The sheet stack 8 rests on a stacking panel 10 which can be raised in a controlled manner. The sheets 7 are removed from the top side of the sheet stack 8 by way of a so-called suction head 18 which, inter alia, has a number of lifting and pull suckers 19, 21 for singling and separating the sheets 7. Also provided are the blowing devices 22 for loosening the top sheet layers and follower elements 23 for stack adjustment. In order to align the sheet stack 8, in particular the top sheets 7 of the sheet stack 8, a number of lateral and rear stops 24 are provided.

Figure 2:
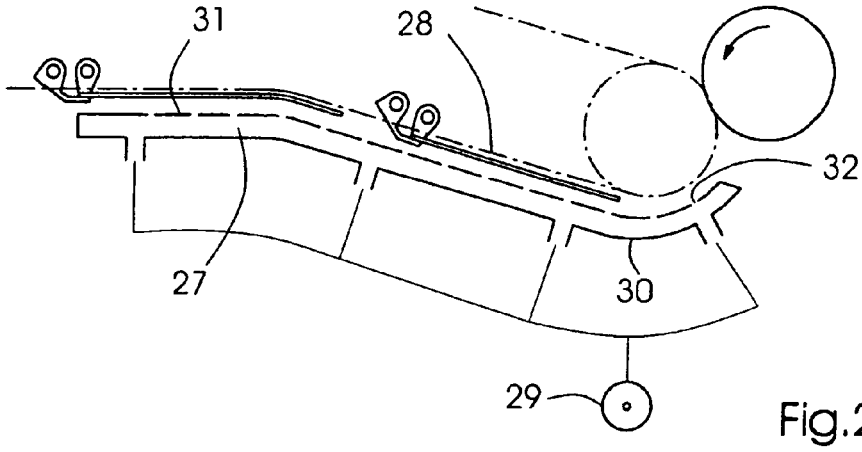
FIG. 2 is a schematic sectional side view of a sheet-directing element in the region of the sheet delivery.
Figure 3:
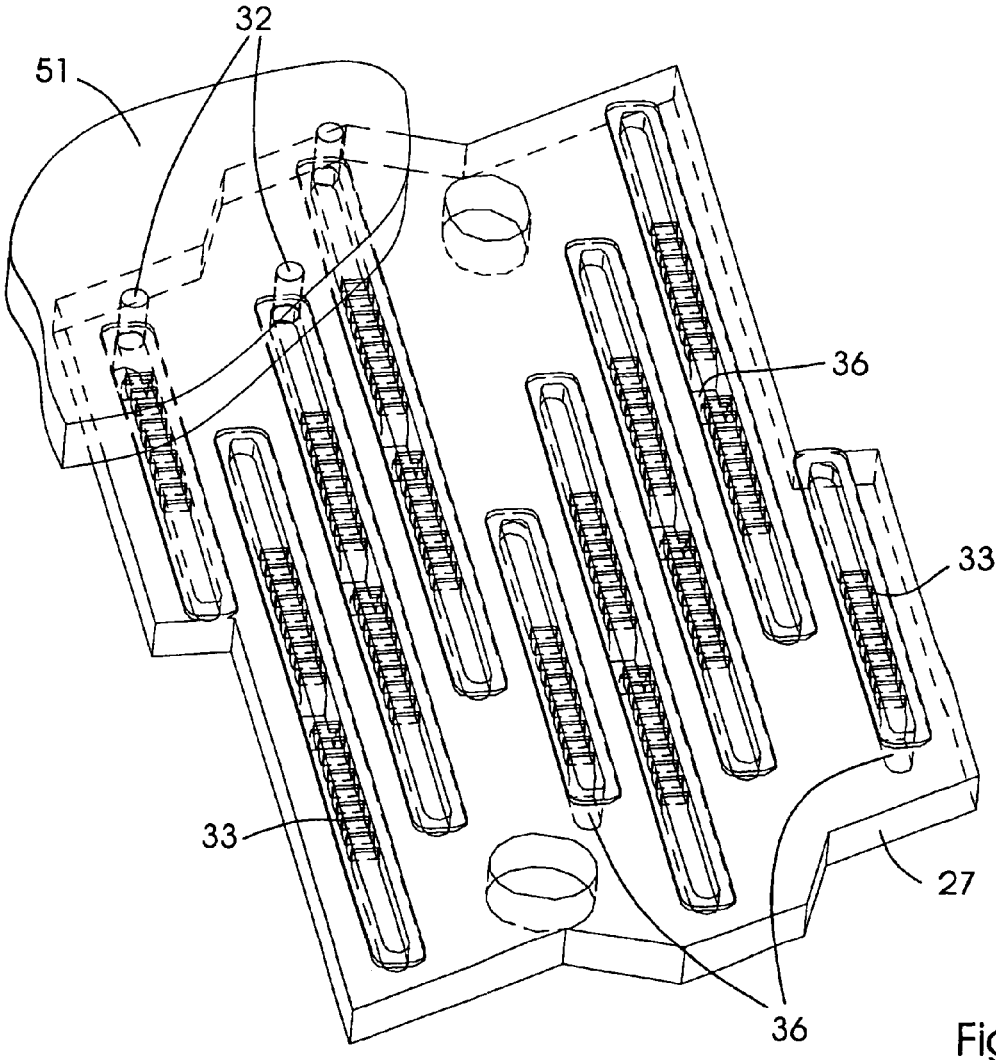
FIG. 3 is a perspective view of the sheet-directing element.

Between the final printing unit 4 and the delivery stack 26, there is disposed a sheet guide 27 in the form of a pneumatic sheet-directing element arranged beneath a chain guide 28. As illustrated in FIG. 2, the sheet-directing element 27 has, on its underside 30, at least one connection for a pressure generator, in particular a blowing-air generator 29. The configuration according to the invention, however, rather than being restricted to blowing air, can be used to the same extent, and without undergoing any alterations, with suction air. On the top side 31 of its body, to be precise on the side which is directed toward the sheet to be transported, the sheet-directing element has a number of outlet openings 32 or nozzles which generate a carrying air cushion of throttled blowing air beneath the sheet and prevent the latter from coming into contact with the sheet-directing element 27. In order to generate the throttled blowing air, a throttle path 33 is provided for each nozzle 32, the throttle path having, between the inlet and outlet openings 36, 32, a flow channel 34 which is provided with a plurality or multiplicity of vortexing elements. The latter are arranged at a spacing distance apart from one another, in and counter to the flow direction, as projections 39 (i.e., noses, beaks, bosses, or shoulders) on a first wall 38 of the flow channel 34. In this case, a gap S is formed between the tips 41 of the projections 39 and second wall, i.e., the opposite wall 42 of the flow channel 34. The gap ensures that the blowing air or suction air flows through. Vortex chambers 44 which give rise to vortexing, and thus throttle the free throughflow of the blowing air or suction air, are formed in each case between two adjacent projections 39, 39.

Figure 4:
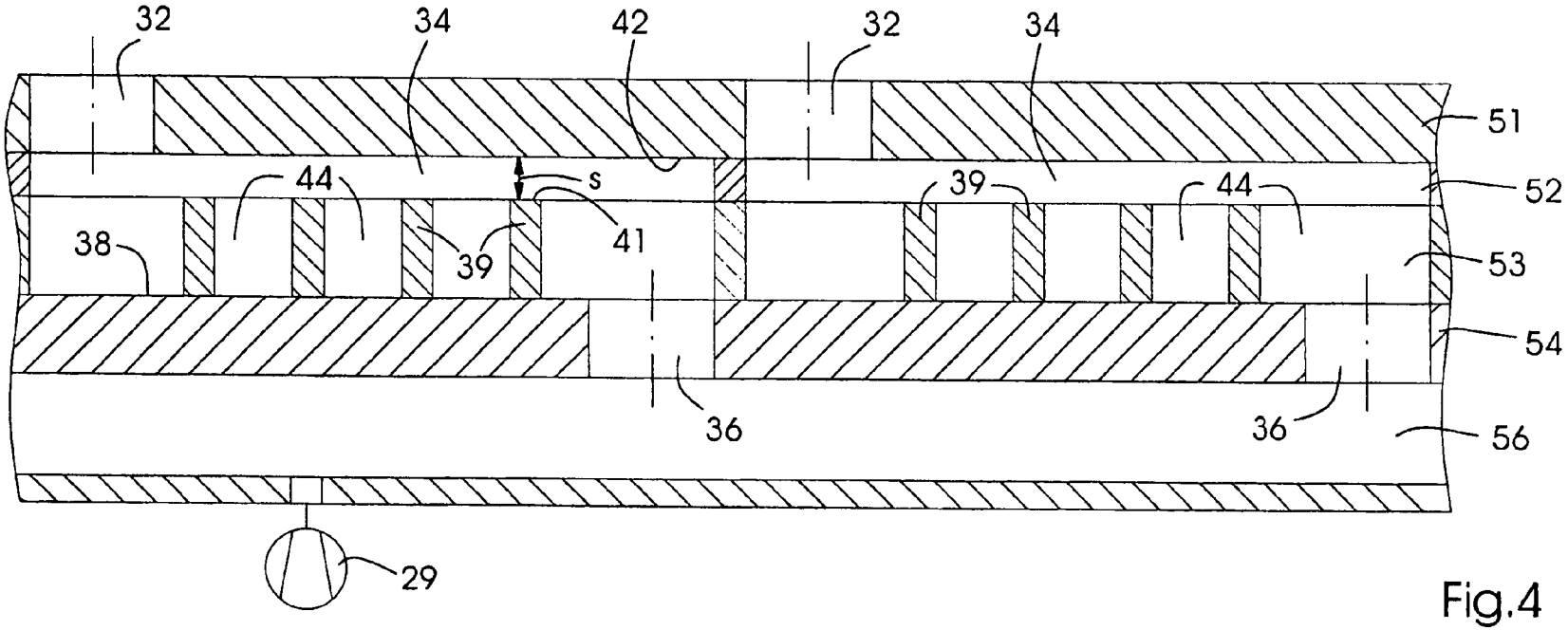
FIG. 4 is a section taken through the sheet-directing element with a throttle path of layered construction.

FIG. 4 shows one way of constructing a throttle path 33 by way of example. In the case of this exemplary embodiment, the throttle path 33 comprises a plurality of layers provided with through-passages:

A carrying and/or directing element 51 formed with at least one outflow opening 32.

A spacer plate 52.

A throttle plate 53.

An inflow plate 54. The inflow plate is formed with at least one inflow opening 36, by way of which it is connected directly to the blowing-air/suction-air generator 29 or, as here, to an antechamber 56. The antechamber 56 is supplied by the blowing-air/suction-air generator 29 and connects all the inflow openings 36 to one another. The through-passages are of different sizes and arranged such that the through-passage in the carrying/directing element 51 forms the nozzle 32. The through-passage in the spacer panel 52 forms the flow channel 34, the through-passages in the throttle panel 53 form the projections 39 and vortex chambers 44, and the through-passage in the inflow panel 54 forms the inflow opening 36.

Figure 5:
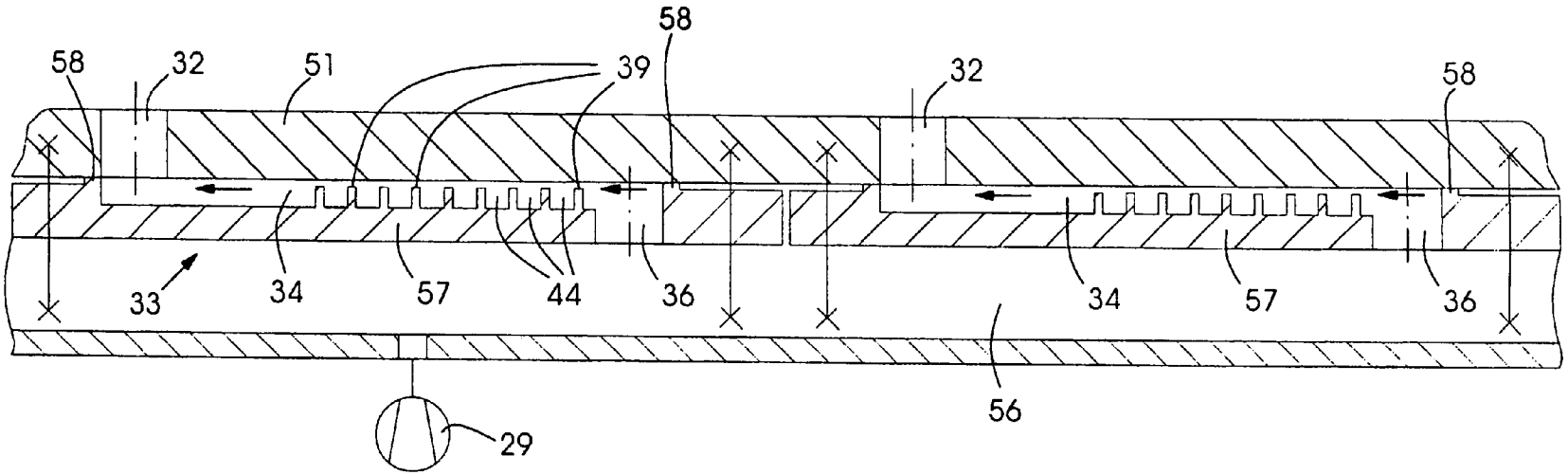
FIG. 5 is a section taken through an alternative sheet-directing element which has been produced by injection molding or stamping.

FIG. 5 shows a further, particularly cost-effective embodiment. The throttle path 33 here comprises primarily two parts, namely the carrying/directing element 51 with outflow opening 32 and a bottom part 57 with inflow opening 36, which, together with the carrying/directing element 51, forms the throttle path 33. The bottom part 57 is produced from a single component, preferably by injection molding. In that case it is possible for the material to be a plastic.

A second production method used is stamping, it likewise being possible for the material which can be used to be a plastic.

The bottom part 57 here has the spaced-apart projections 39 in each case, two adjacent projections 39 respectively forming a vortex chamber 44. The throughflow channel 34 is formed by a shoulder 58 which bounds the throttle path 33 and is pressed against the underside of the carrying/directing element 51. The inflow opening 36 is connected to the blowing-air/suction-air source either directly or, together with the rest of the inflow openings 36, by way of an antechamber 56.

Figure 6:
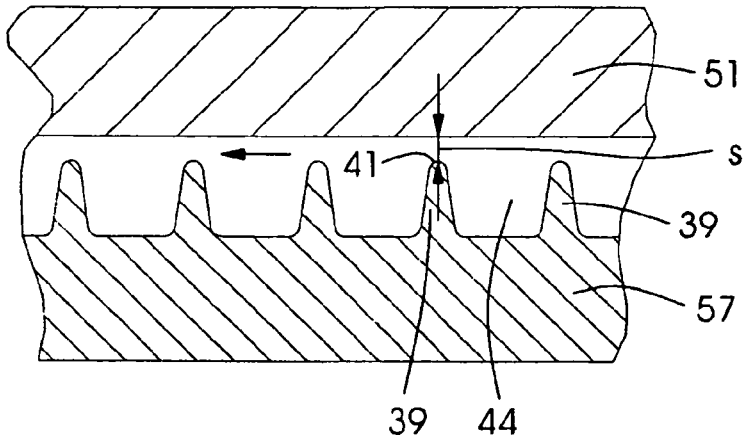
FIG. 6 is a section taken through a throttle path according to FIG. 5.
Figure 7:
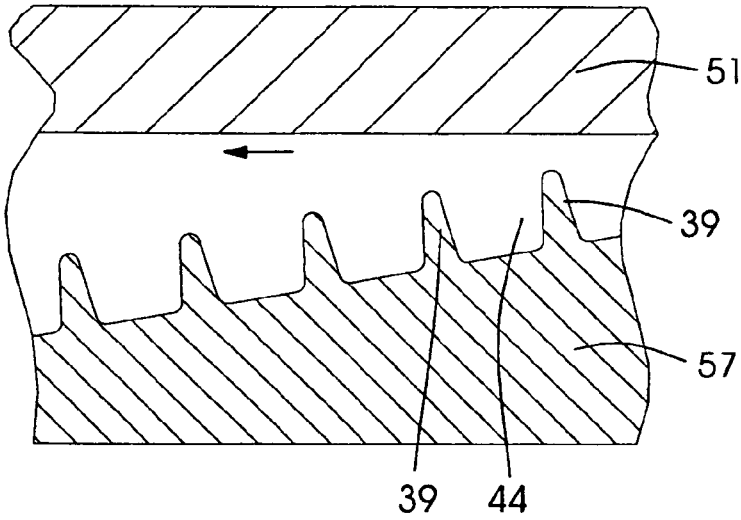
FIG. 7 is a section taken through an alternative throttle path.
Figure 8:
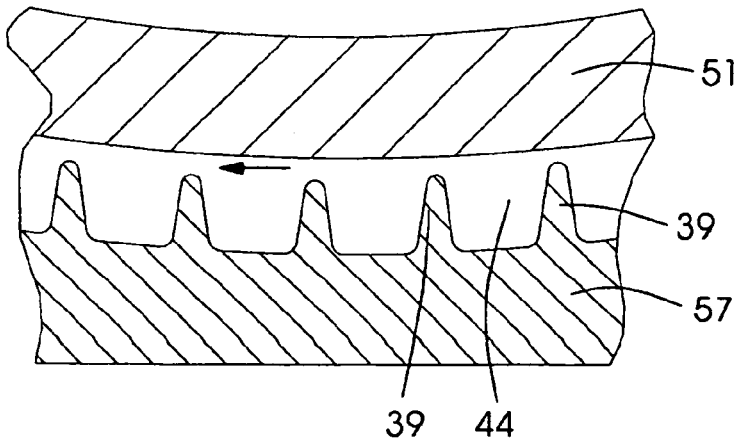
FIG. 8 is a section taken through a second alternative throttle path.

FIGS. 6 to 8 show enlarged views of throttle paths which have been produced by injection molding or stamping. In this case, FIG. 6 shows the already described parallel throttle path 34 with a constant through-gap s between the tips 41 of the projections 39 and the underside of the carrying/directing element 51.

FIG. 7 shows a throttle path 33 with a widening through-gaps.

FIG. 8 shows a throttle path 33 which is adapted to a curved carrying/directing element 51, e.g. for use on cylinders or rollers of printing machines.

I claim:

1. A configuration for generating throttled blowing or suction air, comprising:

a body formed with an inlet, an outlet, and a throttle path between said inlet and said outlet;

said throttle path having a first wall formed with a plurality of mutually spaced-apart projections with tips and a second wall opposing said first wall, said second wall being substantially free of projections;

mutually adjacent said projections on said first wall of said throttle path forming vortex chambers therebetween, and a flow channel being defined between said tips of said projections and said second wall.

2. The configuration according to claim 1, wherein said throttle path is constructed from a plurality of layers formed with through-passages.

3. The configuration according to claim 1, wherein said throttle path is constructed substantially from two parts, including an injection molded bottom part defining said throttle path.

4. The configuration according to claim 3, wherein said bottom part is formed of plastic material.

5. The configuration according to claim 1, wherein said throttle path is constructed substantially from two parts, including a stamped bottom part defining said throttle path.

6. The configuration according to claim 5, wherein said bottom part is formed of plastic material.

7. The configuration according to claim 1, wherein said body is further formed with an antechamber communicating with a plurality of throttle paths and having a connection to a blowing-air or suction-air generator.

8. In combination with a sheet-directing element in a sheet-processing machine, the configuration according to claim 1 forming a part of the sheet-directing element.

9. The combination according to claim 8, wherein said sheet-directing element is disposed in a region of a chain guide towards the delivery.

10. In combination with a sheet-fed rotary printing press, the configuration according to claim 1 with said throttle path integrated in a sheet-directing element of the sheet-fed rotary printing press.

* * * * *